United States Patent [19]

Guillon

[11] 4,311,083

[45] Jan. 19, 1982

[54] ABSOLUTE-CONTROL NUMERICAL HYDRAULIC ACTUATING DEVICE

[75] Inventor: Marcel Guillon, Issy-les-Moulineaux, France

[73] Assignee: Societe Anonyme D.B.A., Paris, France

[21] Appl. No.: 80,893

[22] Filed: Oct. 1, 1979

[30] Foreign Application Priority Data

Oct. 5, 1978 [FR] France ..... 78 28548

[51] Int. Cl.[3] ..... F15B 15/17; F01B 25/02

[52] U.S. Cl. ..... 91/19; 91/20; 91/390; 91/417 R; 91/445

[58] Field of Search ..... 91/19, 20, 417 R, 445, 91/390

[56] References Cited

U.S. PATENT DOCUMENTS

| | | | |
|---|---|---|---|
| 3,732,027 | 5/1973 | Lupke et al. | 91/445 |
| 4,014,248 | 3/1977 | Cyrot | 91/445 |
| 4,114,513 | 9/1978 | Debrus | 91/445 |

*Primary Examiner*—Paul E. Maslousky

*Attorney, Agent, or Firm*—Paul David Schoenle; Ken C. Decker

[57] ABSTRACT

An absolute-control numerical hydraulic actuating device with display of the output position, comprising a hydraulic jack, a distributor formed with orifices and a selector connected to the orifices in order to make the required hydraulic connections for hydraulic locking in the desired output position.

According to the invention, the orifices of the distributor can be selectively connected by the selector to the active chamber of the jack in order hydraulically to lock the output positions in accordance with numerical orders supplied to the selector, and additional intermediate locking positions are created by the provision of additional rows of orifices which can be selectively connected to the high-pressure source, to the low-pressure source, or to the active chamber of the jack through a further selector.

2 Claims, 4 Drawing Figures

ABSOLUTE-CONTROL NUMERICAL HYDRAULIC ACTUATING DEVICE

The invention relates to an absolute-control numerical hydraulic actuating device with display of the output position.

For convenience, the device will hereinafter be denoted by the simplified expression "hydraulic actuator."

There are numerous existing kinds of numerical "incremental"—control hydraulic actuators, i.e. actuators receiving successive unit orders each of which triggers a unit change (positive or negative) in the output position. These actuators, usually have a very simple structure but their disadvantage is that, unless they have a special resetting device, they indefinitely perpetuate any error in the output position caused by electric, hydraulic, mechanical or any other perturbations.

There are also numerous kinds of "absolute"-control numerical hydraulic actuators, i.e. actuators receiving their input orders in the form of a numerical word corresponding to an absolute output position.

The aforementioned absolute-control numerical hydraulic actuators may be divided, firstly, into a class comprising "parallel" actuators in which the outputs of a number of unit positioning elements are mechanically summed to obtain the output position of the system. These actuators have the disadvantage of mechanical complexity, which increases very quickly when the number of output position increases. They also operate jerkily, particularly when the order under consideration corresponds to a change in state of heavier-weight positioning elements.

A second catergory of absolute-control numerical hydraulic actuators comprises actuators with display of the output position in which a single moving power element, such as the piston of a jack, is hydraulically locked by a distributor in a certain number of stationary positions. The distributor comprises a stationary part and a moving part connected to the moving power element of the actuator. The two parts of the distributor have orifices, grooves and the like which move relative to one another and, when an order is given to the actuator, are either connected to one of the hydraulic sources (high-pressure or low-pressure) or connected to the active chamber (or to one of the active chambers) of the actuator, or are disconnected. The relative position of the stationary and moving elements is used for hydraulically locking the actuator, the change-over from one position to another being brought about by a selector which switches some of the distributor orifices.

Known absolute-control numerical hydraulic actuators with display of the output position have the advantage, inherent in their absolute nature, of not perpetuating any error in the starting position, and do not require a resetting device. However, they have a disadvantage in that the distributor and, particularly, the selector are complex and become rapidly more so when the number of actuator output positions increases. This is mainly because the number of switchable pipe systems connecting the selector to the distributor is usually two per output position, as shown inter alia in the article published under the signature "G. Diesel" and entitled "Electrohydraulic digital controls for machine tools" in "Hydraulics and Pneumatics," September 1973.

An object of the invention is to obviate the aforementioned disadvantage and substantially simplify the structure of the distributor and of the selector by reducing the number of switchable pipe systems required for a given number of output devices.

The invention is based on a numerical hydraulic actuating device of the absolute-control kind with display of the output position, comprising a hydraulic jack coupled to a distributor having a moving part connected to the jack piston and comprising at least one land portion which moves along a row of orifices formed in the stationary part so as to cover them in succession, the device also comprising a numerically-actuated selector connected to the various orifices in order selectively to bring about the hydraulic connections required to produce a certain number of discrete locking positions of the jack piston, the hydraulic jack which is of the differential kind having on one side of its piston a chamber of a small cross-section permanently connected to the high-pressure source which supplies fluid to the device, and on the other side of the piston the jack an "active" chamber of a larger cross-section which is supplied with fluid at a variable pressure from the distributor, the land portion of the movable part of the distributor being bounded by the ends of two aligned longitudinal grooves which are communicated with the high-pressure source and with a low-pressure source respectively, and the distributor orifices which are formed along a corresponding generatrix of the stationary part being spaced axially from one another in a number equal to that of the wanted locking positions and being each connectable through the selector to the active chamber of the jack whereas the remaining orifices are disconnected.

The above defined object of the invention is achieved thanks to the fact that, in order to increase the number of locking positions by providing intermediate positions, the land portion of the movable part of distributor is given an axial length substantially greater than that of the various orifices in the row, that in addition to the "main" row of orifices, the stationary distributor body is formed with a number of "auxiliary" rows made up of "collecting" orifices which can be selectively connected by a selector to the active chamber and alternate with "fluid" orifices which in turn can be selectively connected to the high-pressure and low pressure sources, and that the auxiliary rows of orifices aligned along separate generatrices of the distributor body cooperate with an equal number of longitudinal grooves formed along corresponding generatrices of the movable part to define fine locking positions of the jack, starting from the coarse positions obtained by means of the main row of orifices. As will be shown hereinafter, the number of switchable pipe systems can be made smaller than the number of desired output positions by suitably interconnecting the collecting orifices and the fluid orifices of the various auxiliary rows and by suitably dimensioning and offsetting the various longitudinal grooves which cooperate with the auxiliary rows.

The invention will now be explained in greater detail with reference to some preferred embodiments given by way of illustration only, with reference to the accompanying drawings in which.

Figure 2:
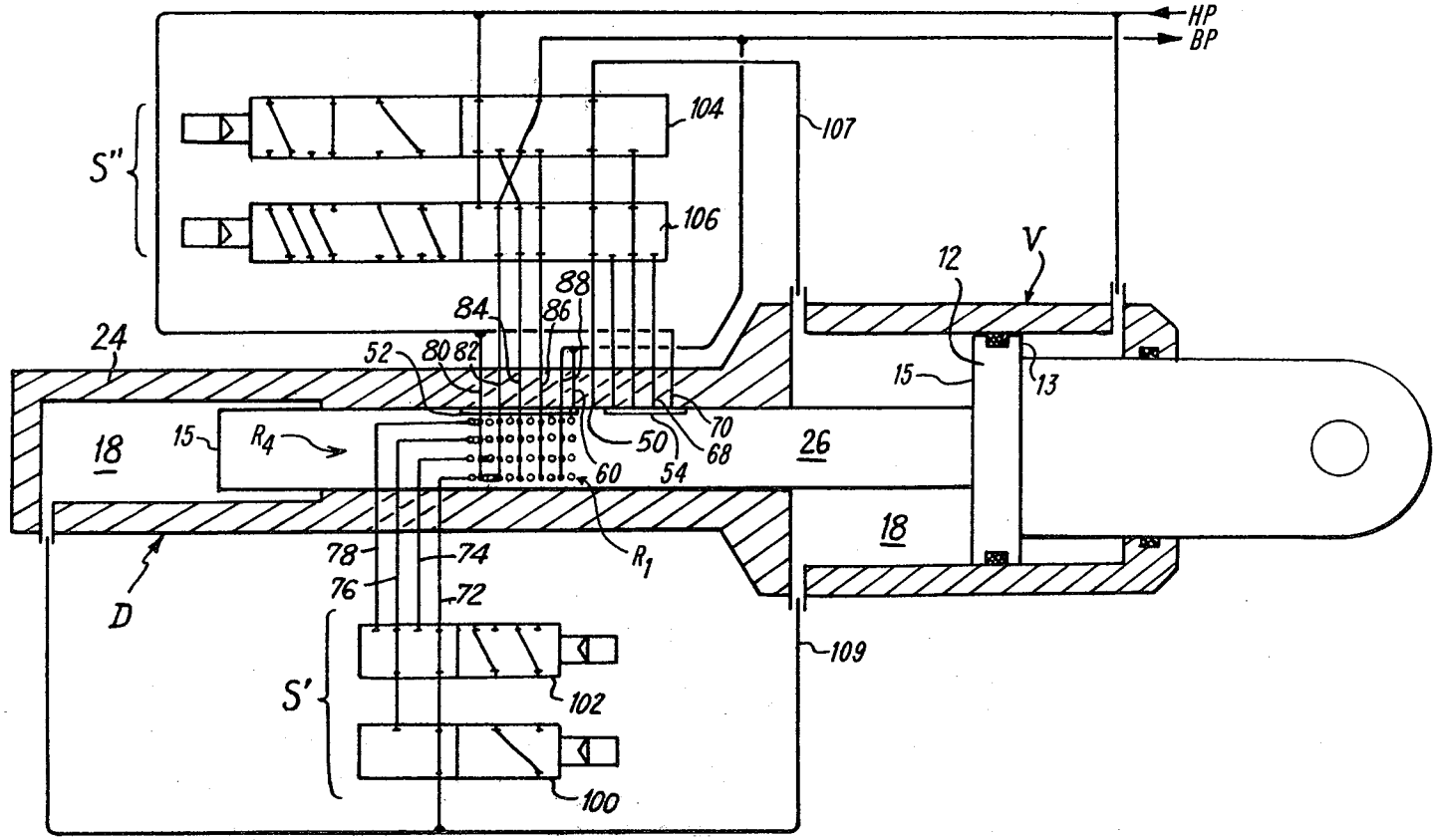
FIG. 2 is a similar view of a first preferred embodiment of the actuator according to the invention, designed for 16 output positions.
Figure 3:
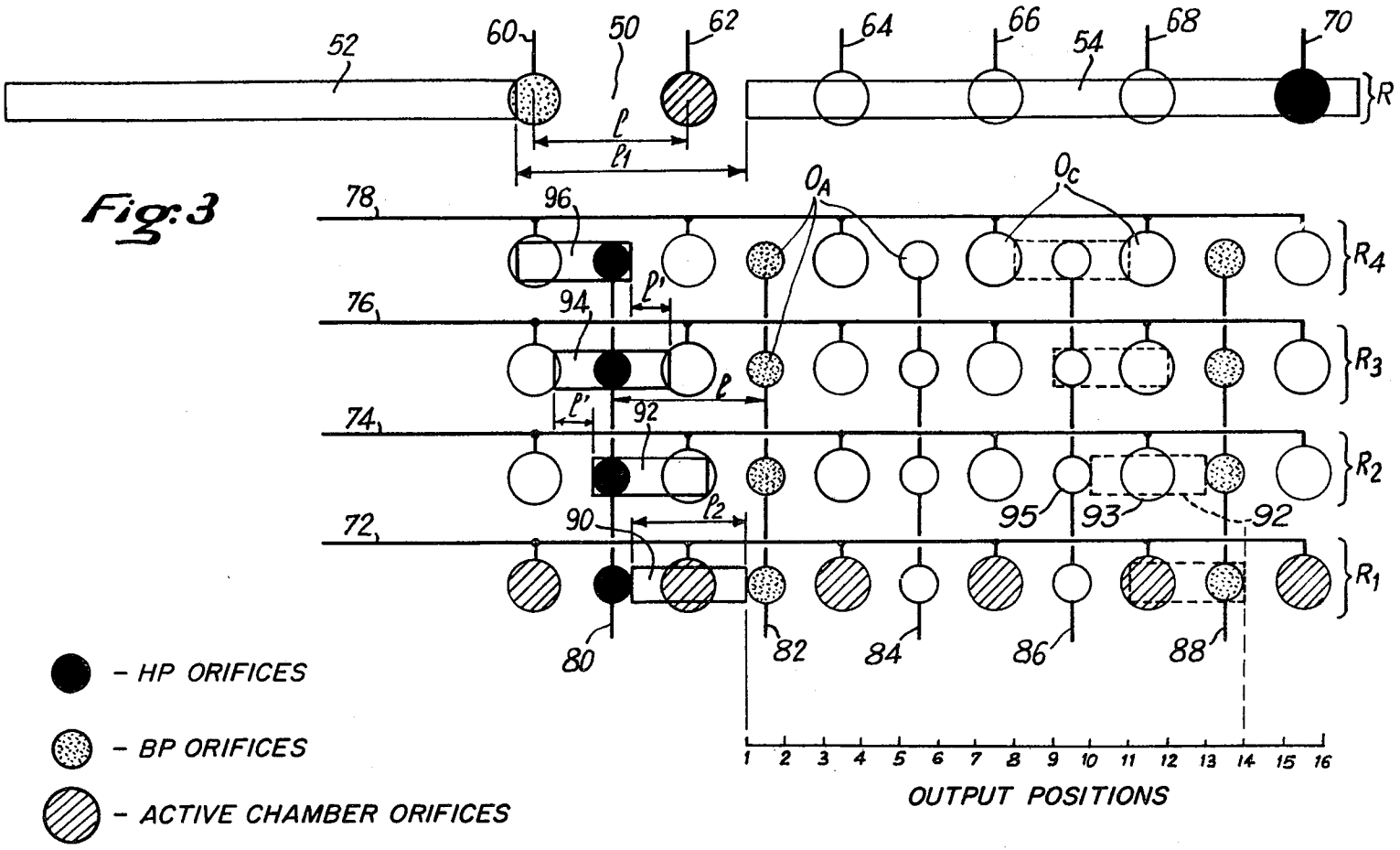
Figure 4:
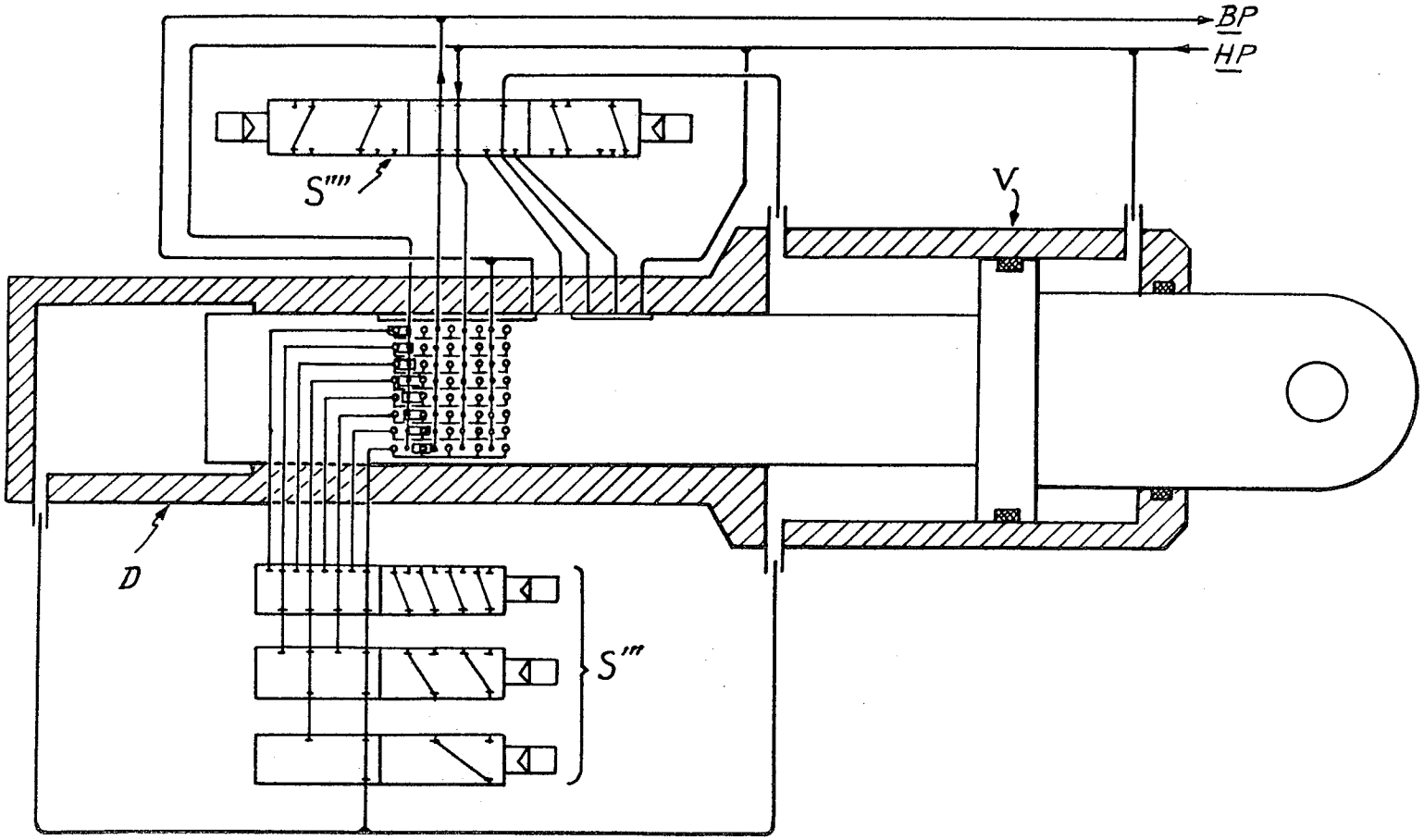

FIG. 3 is an expanded explanatory diagram illustrating the relative positions of the various orifices formed in the stationary distributor body and the cooperating grooves formed in the moving part of the distributor, the diagram being used to explain the operation of the actuator in FIG. 2; and FIG. 4 is a diagrammatic longitudinal section through a second embodiment of the actuator according to the invention, designed for 24 distinct output positions.

Figure 1:
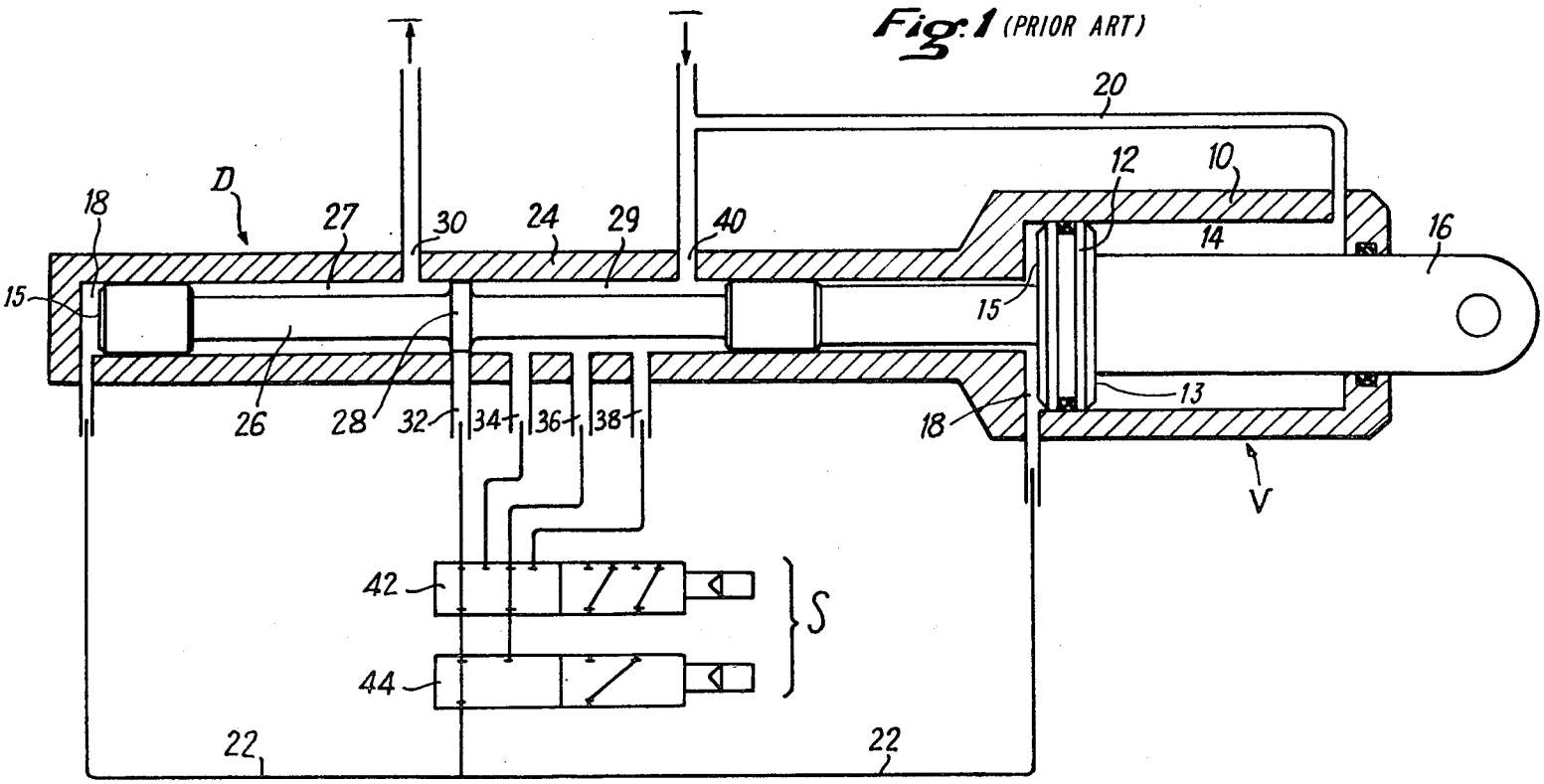
Fig. 1 (PRIOR ART)
FIG. 1 is a diagrammatic longitudinal section through a known construction of numerical hydraulic actuator, designed for four output positions, and only referred to for facilitating the understanding of this invention.

Referring firstly to FIG. 1 of the accompanying drawings, there is shown a known numerical hydraulic actuating device which mainly comprises a hydraulic jack V, a distributor D coupled to the jack, and a selector S which, in the example shown, comprises two conventional electro-distributors.

Jack V has a cylindrical body 10 and a differential piston 12 which divides the internal cavity of body 10 into two chambers 14, 18 having different cross-sections. Chamber 14, which is adjacent the smaller 13 of the two surfaces of piston 12, surrounds the jack outlet element 16 and is connected by a pipe system 20 to the high-pressure fluid source HP (not shown in the drawing). The other or "active" jack chamber 18, in the example under consideration, is divided into two elementary chambers having a total cross-section 15 equal to the geometrical surface of piston 12. A pipe system 22 connects the two elementary chambers 18 to the selector S in order to supply them at a pressure which can be varied between that of the high-pressure source HP and the low-pressure source BP, as will be explained in greater detail hereinafter.

Distributor D has a stationary body 24 secured to the cylindrical body 10 of jack V and a moving part 26 guided in a straight line in the bore in stationary body 24 and mechanically coupled to the jack piston 12. Two peripheral grooves 27, 29 machined on the moving part 26 permanently communicate with the low-pressure fluid source BP and the high-pressure fluid source HP respectively, e.g. via orifices 30 and 40 formed in the stationary body 24. Alternatively, grooves 27, 29 can be connected to the low-pressure and high-pressure fluid sources in any other appropriate manner, inter alia by passages formed in rod 26. The two grooves are separated by a cylindrical portion 28 of the moving part 26.

Distributor body 24 is also formed with four orifices 32, 34, 36, 38 connected by individual pipe systems to selector S. The orifices have a diameter or, if not circular, an axial dimension equal to the axial length of the land portion 28. Orifices 30 and 40 can have the same or different dimensions provided that they are so positioned relative to the structural abutments on the distributor that they can always supply fluid at the extreme positions. In the example shown, orifices 30, 32, 34, 36, 38, 40 are uniformly spaced along the axis of distributor D. The distributor is constructed so that, during its motion, land portion 28 of part 26 covers each orifice 32, 34, 36, 38 but can never completely cover the supply orifices 30 and 40.

The electro-distributors 42 and 44, which combine to form the selector S, are of a kind well-known in the art and have therefore been only diagrammatically shown in the drawings and will not be described in detail. Be it simply said that they are designed so that one or the other of the pipe systems connected to orifices 32, 34, 36, 38 can be selectively connected to pipe system 22, all the others being disconnected, depending upon orders received in the form of binary signals.

The aforementioned hydraulic actuators operates as follows:

In the position shown in FIG. 1, neither of the two electro-distributors 42, 44 is energized (the corresponding order is 00 in binary notation). Selector S then connects orifice 32 of distributor D to the active chamber 18 of jack V whereas orifices 34, 36 and 38 are disconnected. Orifice 32 is exactly covered by land portion 28, and is consequently disconnected from the peripheral grooves 27 and 29. Any change in the axial position of piston 12 and part 26 coupled thereto will result in orifice 32 being connected to one or the other of grooves 27 and 29, thus connecting the active jack chamber 18 to the HP or BP fluid source, the result being an increase or reduction in the intermediate pressure in chamber 18 and a corrective action on the position of the moving assembly, which will continue until orifice 32 has again been covered by land portion 28, i.e. until the detected deviation in the position has been compensated, irrespective of its cause. This results in hydraulic locking in the position shown in the drawing, which will hereinafter be called the "first output position."

If electro-distributor 42 is now energized without energizing electro-distributor 44 (the corresponding order being 01 in binary notation), the effect is to connect the distributor orifice 34 to the pipe system 22 and the active chamber 18, whereas the other orifices 32, 36 and 38 are disconnected. The result is that the active chamber 18 is connected to the HP fluid source by selector S, orifice 34 and peripheral groove 29. This causes piston 12 and the moving part 26 to move rapidly towards the right of the drawing until land portion 28 covers orifice 34, when the moving assembly is held in this "second position" where hydraulic locking is brought about in the same manner as explained previously. Similarly, it can be seen that binary orders "10" (electro-distributor 42 de-energized, electro-distributor 44 energized) and "11" (electro-distributors 42 and 44 simultaneously energized), if transmitted to selector S, will result in the third orifice 36 and the fourth orifice 38 respectively being connected to the active chamber 18 whereas the other three orifices in the row will be disconnected in each case. This corresponds to a third and fourth output position respectively of the device.

In certain applications, land portion 28 can have an axial length greater than the axial length of orifices 32, 34, 36 and 38. This will result in a certain "indefiniteness" in the locking positions, which inter alia may reduce leaks between the portion and the bore if there is a radial clearance. Of course, orifices 32, 34, 36, 38 need not be equidistant and disposed parallel to the distributor axis.

As can be seen, the number of switchable pipe systems is four in the example under consideration, i.e. is equal to the number of desired output positions. This is a simplication over some of the prior art, in which hydraulic locking is obtained by different combinations, usually requiring two separate orifices and two switchable pipe systems per output position.

In addition, the moving assembly of the aforementioned hydraulic actuator can be used to obtain any of the aforementioned four output positions starting from any initial position, in response to a single order. The actuator, accordingly, is of the absolute kind, and any accidental error will be automatically cancelled during the subsequent operation.

Of course, the number of output positions may be greater than four and, more generally, a selector S comprising n two-position electro-distributors can be used to obtain $2^n$ distinct output positions, but the selector will become rather complex beyond n=3.

The present invention has for its object to avoid the last-mentioned disadvantage or at least reduce same, and is illustrated in a first preferred embodiment in FIGS. 2 and 3 of the accompanying drawings, which is designed for 16 distinct output positions.

In FIGS. 2 and 3, elements corresponding to those in the construction shown in FIG. 1 are given the same reference numbers.

The main difference over the known device is in the construction of distributor D and the selector, which is the present case is made up of two groups S', S'', each of two 2-position electro-distributors.

As shown in FIG. 2 and even more clearly in the expanded diagram in FIG. 3, the stationary body 24 of distributor D is also formed with a "main" row of six orifices 60, 62, 64, 66, 68, 70 which, in the example under consideration, are uniformly spaced along a generatrix of body 24. As in the construction shown in FIG. 1, the two end orifices 60 and 70 are permanently connected to the low-pressure fluid source BP and the high-pressure source HP respectively, whereas each intermediate orifice 62, 64, 66, 68 can be selectively connected to the active chamber 18 of jack V by selector S'', when all the other intermediate orifices in the row are disconnected. By contrast, however, with the known device, the land portion 50 of part 26 is bounded by the ends of two aligned longitudinal grooves 52, 54 formed in the moving part and permanently connected to orifice 60 and orifice 70 respectively. Grooves 52, 54 are milled or machined in any other manner along a generatrix of part 26, whose position coincides with that of the main row of orifices 60 . . . 70 formed in the stationary body 24. In order to maintain the coincidence, part 26 is locked in rotation relative to body 24. The axial length $l_1$ of land portion 50, instead of being equal to the uniform diameter of the various orifices in the row as before, is made considerably greater so that, in some positions, it can simultaneously cover two consecutive orifices in the row, except, however, that it can only partly cover the end orifices 60 and 70. The result of this feature is that the assembly comprising orifices 60 . . . 70, land portion 50 and grooves 52 and 54 can be used only to obtain an approximate locking position, as will be explained in greater detail hereinafter. In addition to the main row R of equidistant orifices, body 24 is formed with four "auxiliary" rows $R_1 \ldots R_4$, each of six "collecting" orifices $O_C$, which are likewise equidistant in the example under consideration and alternate with five supply orifices $O_A$ each formed between two consecutive collecting orifices. As shown in FIG. 3, all the orifices making up a given row are formed along a generatrix of body 24 separate from the generatrices occupied by the other rows of orifices. As FIG. 3 shows, the collecting orifices $O_C$ in each auxiliary row $R_1 \ldots R_4$ are equal in number to the orifices in the main row R (six in the example under consideration) and, in the example, the spacing l between them is identical. This, however, is only a special case, which in no way limits the invention. Furthermore, the axial offset in FIG. 2 between the main row of orifices and the auxiliary rows has been introduced only to simplify the drawing. All the collecting orifices in a given row $R_1 \ldots R_4$ are connected to a common pipe system 72 . . . 78 which selector S' can selectively disconnect or connect to the active chamber 18 of jack V. The fluid orifices $O_A$ (five per auxiliary row in the present case) are formed with a constant spacing l, each between two consecutive collecting orifices $O_C$; as FIG. 3 shows, the supply orifices in the various auxiliary rows contained in a given plane perpendicular to the distributor axis are connected to a common pipe system 80 . . . 88. The first aforementioned pipe system 80 is permanently connected to the high-pressure fluid source HP whereas the last common pipe system 88 is connected to the low-pressure source BP. The common intermediate pipe system 82, 84, 86 can be selectively disconnected or connected by selector S'' to source HP or BP. The various auxiliary rows of orifices $R_1 \ldots R_4$ cooperate respectively with longitudinal grooves 90 . . . 96 formed along corresponding generatrices of the moving part 26 of distributor D, each groove having an axial length $l_2$ exactly equal to the distance between two consecutive fluid orifices $O_A$. As shown hereinafter, the longitudinal grooves cooperate with the fluid orifices in the various auxiliary rows to define the exact locking positions of the actuator according to the invention, starting from a coarse position obtained by means of the orifices in the main row R. Furthermore, the longitudinal grooves 90 . . . 96 are axially offset from one another by a distance l' equal to a forward pitch of the desired output positions. The fluid orifices $O_A$ in the various auxiliary rows $R_1 \ldots R_4$ have a diameter limited to l', i.e. the length $l_2$ of each longitudinal groove is equal to the distance between the spacing l of the fluid orifices $O_A$ and the forward pitch L' of the output positions of the hydraulic actuator. The other orifices in body 24, i.e. orifices 60 . . . 70 in the main row R and the collecting orifices $O_C$ in the various auxiliary rows $R_1 \ldots R_4$ have a diameter slightly greater than l'.

In order to ensure that, in every position of the jack, the hydraulic communications are maintained as required for the piston to move towards the displayed position, the selector forming part of the aforementioned hydraulic actuator, as previously mentioned, comprises two groups S' and S'' electro-distributors. The first group S', which is made up of two electro-distributors 100 and 102, has a structure comparable with that of selector S in the construction shown in FIG. 1 and is adapted to connect one of the auxiliary rows of orifices $R_1 \ldots R_4$ to the active chamber 18 via the common pipe systems 72 . . . 78, leaving all the others disconnected. The second group S'', which likewise comprises two electro-distributors 104 and 106, has a somewhat more complex structure and performs two functions. Firstly, it connects one of or the other of the intermediate orifices 62 . . . 68 in the main row of orifices R to the active chamber 18 while disconnecting the other intermediate orifices and, secondly, it disconnects or connects one or two of the common intermediate supply pipe systems 82 . . . 86 to the high-pressure HP or the low-pressure BP source of fluid. Electro-distributors 104 and 106 are designated so that, whenever an intermediate orifice 62 . . . 68 in the main row R is connected to the active chamber 18, the common supply pipe system (80) . . . 86 immediately to the left of the orifice, as shown in FIG. 3, is connected to the high-pressure fluid source whereas the common supply pipe system 82 . . . (88) immediately to the right is connected to the low-pressure fluid source. In practice, the purpose of group S'' is to obtain the coarse output position, i.e. to determine that group of four forward pitches with includes the desired output position. However, it does not allow the device actuated by group S' to operate except in the immediate neighbourhood of the group of four positions aimed at. Group S', on the other hand, is adapted to specify the desired output position within the group of four positions in which it is situated.

Each group of output positions is divided into four distinct positions since, in the example in question, the number of auxiliary rows of orifices is four. Consequently, the previously-defined spacing 1 is equal to four forward pitches of the moving assembly. More generally, the number q of auxiliary rows of orifices must be made equal to the total number p of desired output positions divided by the number p' of coarse positions which can be obtained by the main row; each auxiliary row must have (p'+2) collecting orifices $O_C$ and (p'+1) fluid orifices $O_A$, and the value 1' of the forward pitch of the output positions is related as follows to the value 1 of the spacing between orifices of similar nature and to the number q of auxiliary rows: $1'=1/q$ Returning to the embodiment shown in FIGS. 2 and 3, the following table indicates the correspondence between the displayed output positions and the state of the control solenoids of the electro-distributors 100, 102, 104, 106 forming the selector assembly:

| Electro-distributors | Output position 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 104 | 0 | 0 | 0 | 0 | 0 | 0 | 0 | 0 | 1 | 1 | 1 | 1 | 1 | 1 | 1 | 1 |
| 106 | 0 | 0 | 0 | 0 | 1 | 1 | 1 | 1 | 0 | 0 | 0 | 0 | 1 | 1 | 1 | 1 |
| 100 | 0 | 0 | 1 | 1 | 0 | 0 | 1 | 1 | 0 | 0 | 1 | 1 | 0 | 0 | 1 | 1 |
| 102 | 0 | 1 | 0 | 1 | 0 | 1 | 0 | 1 | 0 | 1 | 0 | 1 | 0 | 1 | 0 | 1 |

As can easily be seen from the table, the output positions of the hydraulic actuator are displayed by means of orders delivered to the selector in the form of a set of binary numbers.

To explain the operation of the hydraulic actuator it will be assumed, by way of example, that it occupies position No. 1 as shown in FIGS. 2 and 3 and receives the order to move to position 14. Since this position is the second in the fourth-group of four, the order reaching the selector electro-distributors will energize electro-distributors 104, 106, 102, as shown in the Table, and will leave electro-distributor 100 disconnected. Thus, chamber 18 will be connected to orifice 68 in the main row R via conduit 107 and distributors 106 and 104, and, via the common pipe system 74, the conduit 109 and the distributor 100 and 102, to orifice $O_C$ at 93 in the second auxiliary row $R_2$. The high-pressure HP fluid source is also connected to the common supply pipe system 86 whereas the pipe system 88 is permanently connected to the low-pressure BP source of fluid. During a first period, orifice 68 supplies chamber 18 with high-pressure fluid via HP orifice 70 and groove 54, and piston 12 moves to the right, to slightly beyond position 12. However, as soon as it reaches position 10, chamber 18 is also supplied with high-pressure fluid via one of the fluid orifices $O_A$ at 95 connected to the common pipe system 86 and via the moving groove 92 and one of the collecting orifices 93 connected to the common pipe system 74 in the auxiliary row $R_2$. This supply system, which thus takes over from the first, continues until groove 92 is between the fluid orifices in row $R_2$ which are respectively connected to pipe system 86 and pipe system 88, see 92 in phantom of FIG. 3. The actuator has then reached the displayed position 14, where it is hydraulically locked.

Therefore, any output position can be reached from any other position as a result of a single order, without any break or bypass in the supply.

As FIG. 2 also shows, the 16 desired output positions can be obtained by means of an absolute-control hydraulic actuator requiring only 11 switchable pipe systems between the selector and the distributor, i.e. less than 1 switchable pipe system per output position.

The invention can thus be used to construct absolute-control hydraulic actuators having a large number of output positions without prohibitively increasing the complexity of the associated distributor and selector.

In addition, the number of output positions is not necessarily a power of 2. In this connection, FIG. 4 illustrates another embodiment of the invention in which the number of outputs is 24. In this case, in accordance with the preceding remarks, three groups of 8 positions are provided, i.e. the main row has 5 orifices (p'+2=5) and each of the eight (q=8) auxiliary rows likewise has five collecting orifices (p'+2=5) and four fluid orifices (p'+1=4). Of course, numerous other combinations are also possible.

Of course, the scope of the invention is not limited to the details of the embodiments given in the preceding description or in the accompanying drawings, which have been given only by way of example. The grooves and orifices in the distributor can be combined in various other ways, if the necessary communications are provided between the high-pressure fluid source, the low-pressure fluid source and the active jack chamber. The invention, if suitably adapted, can also be applied to straight double-acting jacks, rotary jacks, or rotary hydraulic motors.

I claim:

1. A numerical hydraulic actuating device for absolute-control of an output position for a piston, comprising a distributor having a moving part connected to the piston and comprising at least one land portion which moves along a main row of distributor orifices formed in a stationary part of the distributor so as to cover them in succession, the device also comprising a numerically-actuated selector means connected to the various orifices in order to selectively establish hydraulic connections required to produce a certain number of discrete coarse locking positions of the piston, the piston which is of the differential kind having on one side a chamber of a small cross-section permanently connected to a high-pressure source which supplies fluid to the device, and on the other side forming an active chamber of a larger cross-section which is supplied with fluid at a variable pressure from the distributor, the land portion of the movable part of the distributor being bounded by the ends of two aligned longitudinal grooves which are communicated with the high-pressure source and with a low-pressure source respectively, and the distributor orifices which are formed along a corresponding generatrix of the stationary part being spaced axially from one another in a number equal to that of the wanted locking positions and being each connectable through the selector means to the active chamber whereas the remaining orifices are disconnected, the improvement wherein, in order to increase the number of locking positions by providing intermediate positions, the land portion of the movable part of the distributor is given an axial length substantially greater than that of the various orifices in the main row, that, in addition to the main row of distributor orifices, the stationary part of the distributor is formed with a number of auxiliary rows made up of collecting orifices which can be selectively connected by the selector means to the active chamber and alternate with fluid orifices which in turn can be selectively connected to the high-pressure and low-pressure sources, and that the auxiliary rows of orifices aligned along separate generatrices of the stationary part of the distributor cooperate with an equal number of longitudinal grooves formed along corresponding generatrices of the movable part to define fine locking positions of the piston, starting from the coarse positions of the piston obtained by means of the main row of distributor orifices.

2. A numerical hydraulic actuating device according to claim 1, wherein the number of auxiliary rows being made equal to the total number P of desired locking positions divided by the number of coarse positions P' which can be obtained by means of the main row, is made up a number (p'+2) of collecting orifices, all the collecting orifices in each row being connected to a common pipe system which the selector means can disconnect or selectively connect to the active chamber, each auxiliary row also comprising a number of fluid orifices each being formed between two consecutive collecting orifices, the fluid orifices in the various auxiliary rows contained in a same plane perpendicular to the distributor axis being connected to a common pipe system, the first and the last of the common pipe systems being connected to the high-pressure and the low-pressure sources respectively or vice versa, whereas the common intermediate pipe systems can be disconnected or selectively connected by the selector means either to the high-pressure source or the low-pressure source, and wherein the longitudinal grooves, which cooperate with the auxiliary rows and are formed on the movable part of the distributor, each have a length limited to the distance between two consecutive fluid orifices, the various grooves being axially offset from one another by an amount equal to a forward pitch of the desired locking positions.

* * * * *